US009498736B2

(12) United States Patent
Haut

(10) Patent No.: US 9,498,736 B2
(45) Date of Patent: Nov. 22, 2016

(54) DEVELOPMENT APPARATUS

(71) Applicant: Marcia L. Haut, Noblesville, IN (US)

(72) Inventor: Marcia L. Haut, Noblesville, IN (US)

(73) Assignee: Marcia L. Haut, Noblesville, IN (US)

( * ) Notice: Subject to any disclaimer, the term of this patent is extended or adjusted under 35 U.S.C. 154(b) by 0 days.

(21) Appl. No.: 14/513,883

(22) Filed: Oct. 14, 2014

(65) Prior Publication Data

US 2015/0104997 A1 Apr. 16, 2015

Related U.S. Application Data

(60) Provisional application No. 61/890,962, filed on Oct. 15, 2013.

(51) Int. Cl.
*A63H 33/22* (2006.01)
*A63H 33/00* (2006.01)

(52) U.S. Cl.
CPC ..... *A63H 33/22* (2013.01); *A63H 33/006* (2013.01)

(58) Field of Classification Search
CPC ..... A63H 33/22
See application file for complete search history.

(56) References Cited

U.S. PATENT DOCUMENTS

| | | | | |
|---|---|---|---|---|
| 5,139,455 | A * | 8/1992 | Israel | G09B 23/22 434/371 |
| 2004/0077264 | A1* | 4/2004 | Walker | A63H 33/26 446/175 |
| 2004/0141321 | A1* | 7/2004 | Dowling | A63H 33/22 362/276 |

* cited by examiner

*Primary Examiner* — Michael Dennis
(74) *Attorney, Agent, or Firm* — Warner Norcross & Judd LLP

(57) ABSTRACT

An infant development toy that comprises a body configured to be held by a person and a light source located on or with the body. The light source being configured to be energized by motion of the body and deactivated automatically after a period of time of inactivity but then re-energized when motion reoccurs.

13 Claims, 4 Drawing Sheets

DEVELOPMENT APPARATUS

This application claims the benefit of U.S. Provisional Patent Application No. 61/890,962, filed Oct. 15, 2013, which is incorporated herein by reference in its entirety.

TECHNICAL FIELD AND BACKGROUND OF THE INVENTION

The present invention generally relates to an apparatus and method to enhance the development of visual tracking capacity of an individual. While the invention can be useful with individuals of all ages, it is particularly useful with infants and young children.

According to research on early childhood brain development, brains develop starting with the simplest of the circuits and then progressing to more of the complex circuits. Sensory circuits for basic vision and hearing are generally considered some of the more simple circuits. As such, sensory circuits are some of the first to develop, followed by early language skills and higher cognitive skills. Visual and auditory tracking are therefore important early developmental milestones in a child's early development.

SUMMARY OF THE INVENTION

Accordingly, the invention provides an apparatus and method to enhance the visual and/or auditory development of an individual, particularly infants and young children.

In one form of the invention, the apparatus is configured to be held by a person and includes a light source. The location of the light source on or within the apparatus can be varied. The light source is energized by motion of the apparatus, such as by tapping or shaking, and deactivated automatically after a period of time of inactivity but then re-energized when motion reoccurs.

For example, the period of time of inactivity may vary from about 180 seconds to 15 seconds, or from about 120 seconds to 45 seconds, and optionally about 60 seconds.

In one aspect, the apparatus is configured as a toy, such as a rattle. For example, the toy may have a base and a head, with the light source located in the head. Further, the toy may have one or more tactile regions to further enhance the development of an infant holding the rattle.

In a further aspect, the head is connected to the base by a neck. For example the tactile regions may be applied to the neck, base or head. In one form the tactile regions comprise semicircle bodies mounted to the neck. In another form, the tactile regions they comprise stripes on the base. In an in yet another form, the tactile regions comprise a pair of ears mounted about the head. For example, suitable tactile materials may comprise elastomeric materials.

Other aspect, the light source can be a single source or multiple sources. Further, the light source may generate different intensities or colors, such as red, blue, and green.

Additionally, the light source may switch between the intensities or the colors in response to subsequent motion. For example, upon a first motion the light source may generate a first colored light, after a second motion the light source may generate a second colored light, and after a third motion the light may generate a third colored light. The first colored light may comprise red, the second colored light may comprise blue, and the third colored light may comprise green. For example, a suitable light source may comprise an LED or multiple LEDs. The color change can be achieved by using multiple LEDs, each with a different color and with each LED being independently energized to generate their respective wavelength of the light to produce the desired color. Alternately, this can be achieved with a single LED or a group of LEDs that are selectively powered together, but with the frequency of the light output of the LED or LEDs being changed by a control circuit to vary the color.

In a further aspect, the first, second, and third motions need a minimum time between them to trigger the light source to change color.

In another aspect, the light source, for example, may be encased behind a transparent or translucent body, such as a lens. The design, construction, size, and shape of the transparent or translucent body covering the light source may vary. For example, when formed as a rattle, the transparent or translucent body may form part of the rattle head. In one aspect, the head is configured as a round head with facial markings, such as eyes and a mouth. The face may be formed in its entirety by transparent or translucent body so that when the light is activated the whole face lights up.

Optionally, in any of the toys or rattles above, the rattle may include a neck between the head and the base, which provides a gripping surface and further may include tactile structures, such as tactile bumps, including semi-spherical bodies that project from the neck.

In one aspect, the neck is formed from a cylindrical member, which is joined at one end to the head and at its other end to the base.

Optionally in any of the rattles above, the rattle may include a hollow base, which houses a plurality of bodies, such as beads, so that when the rattle is moved or shaken the base generates a rattle noise.

Further, in any of the above toys or rattles, the rattle may include a base that is configured to rest and support the rattle on a flat horizontal surface.

In a further aspect, the base comprises a bell-shaped body, with a flat bottom surface so that the rattle can sit on a horizontal surface and support the rattle in an upright orientation.

In any of the above toys or rattles, the rattle may include reflective surface. For example, the reflective surface may be located in the base.

According to a method of stimulating a child or infant of the present invention, the method includes providing an apparatus with a light source that is selectively powered in response to movement of the apparatus and moving the apparatus to generate light with the light source. When the light is powered, the method further includes manipulating the apparatus in front of a child or infant (hereafter referred to as a "child") by holding the apparatus in proximity to the child's face (e.g. 8 to 18 inches in front of the child's face) and then moving the apparatus in a back and forth motion to draw the attention of the child to the apparatus.

Further, depending on the age of the child, the back and forth motion may alternately, or in addition, include up and down motion.

For example, moving the apparatus to generate light may be achieved by tapping or shaking the apparatus.

In addition, the apparatus may comprise any of the apparatuses described above.

In a further aspect, the moving of the apparatus causes the intensity or color of the light to change. For example, the moving includes moving the apparatus back and forth for a first period of time, followed by moving the apparatus back and forth for a second period of time, which causes the intensity or color of light to change to a second intensity or color. In addition, when the moving the apparatus back and forth for the second period of time is followed by moving back and forth for a third period of time, the color of light to changes to a third intensity or color.

Accordingly, the present invention provides a method and apparatus that draws a child's attention to the apparatus by creating a visually appealing object that can be detected by even an infant and moving that visually appealing object. Once the child has turned his or her attention to the apparatus, the slow motion of the apparatus, e.g. in a back and forth or up and down motion, encourages the child to track the apparatus, which facilitates the development of the child's visual tracking capacity. Such activity can be encouraged in infants beginning at birth.

The acts of focusing on and following the motion of the apparatus with the light source activated will encourage development of the subject child's visual skills, including attention, tracking, processing, discrimination, and acuity. Further changing the intensity or color of the light, also draws the child attention to the apparatus. Additionally, when more than one color of light source is incorporated into the apparatus, this may also encourage a child's ability to recognize and identify colors and/or encourage development of a child's recognition of cause and effect.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and is capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE DRAWINGS

DETAILED DESCRIPTION OF THE PREFERRED EMBODIMENTS

Figure 2:
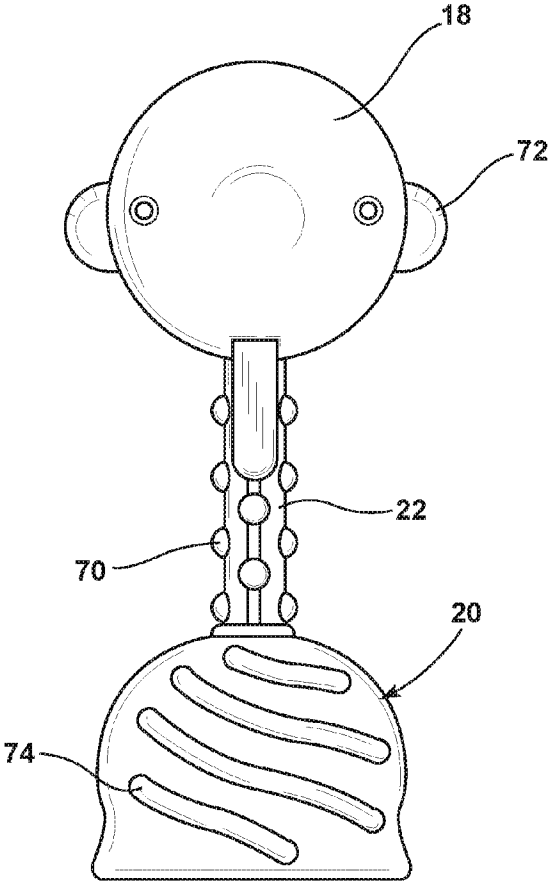
FIG. 2 is a rear elevation view of the apparatus of FIG. 1.
Figure 1:
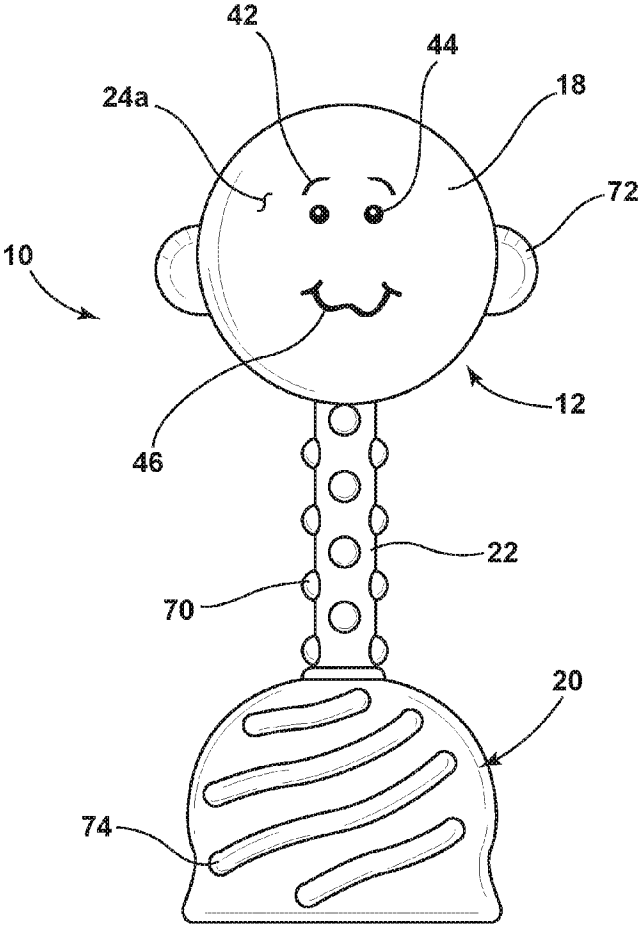
FIG. 1 is a front elevation view of an apparatus of the present invention.

Referring to FIG. 1, the numeral 10 generally designates an apparatus of the present invention. As will be more fully described below, apparatus 10 is configured to enhance the development of visual tracking capacity of an individual by generating an eye catching image that can change in response to input from a caregiver or the individual whose tracking skills are being enhanced. In the illustrated embodiment, apparatus 10 is configured in the form of a toy, and more particularly in the form of a rattle. In this manner, the input may be provided by a parent or other caregiver or by the infant in the form of a tapping motion, rattling motion or when the child drops the toy. Though it should be understood that other types of movement can be used as input to change the image.

Figure 3:
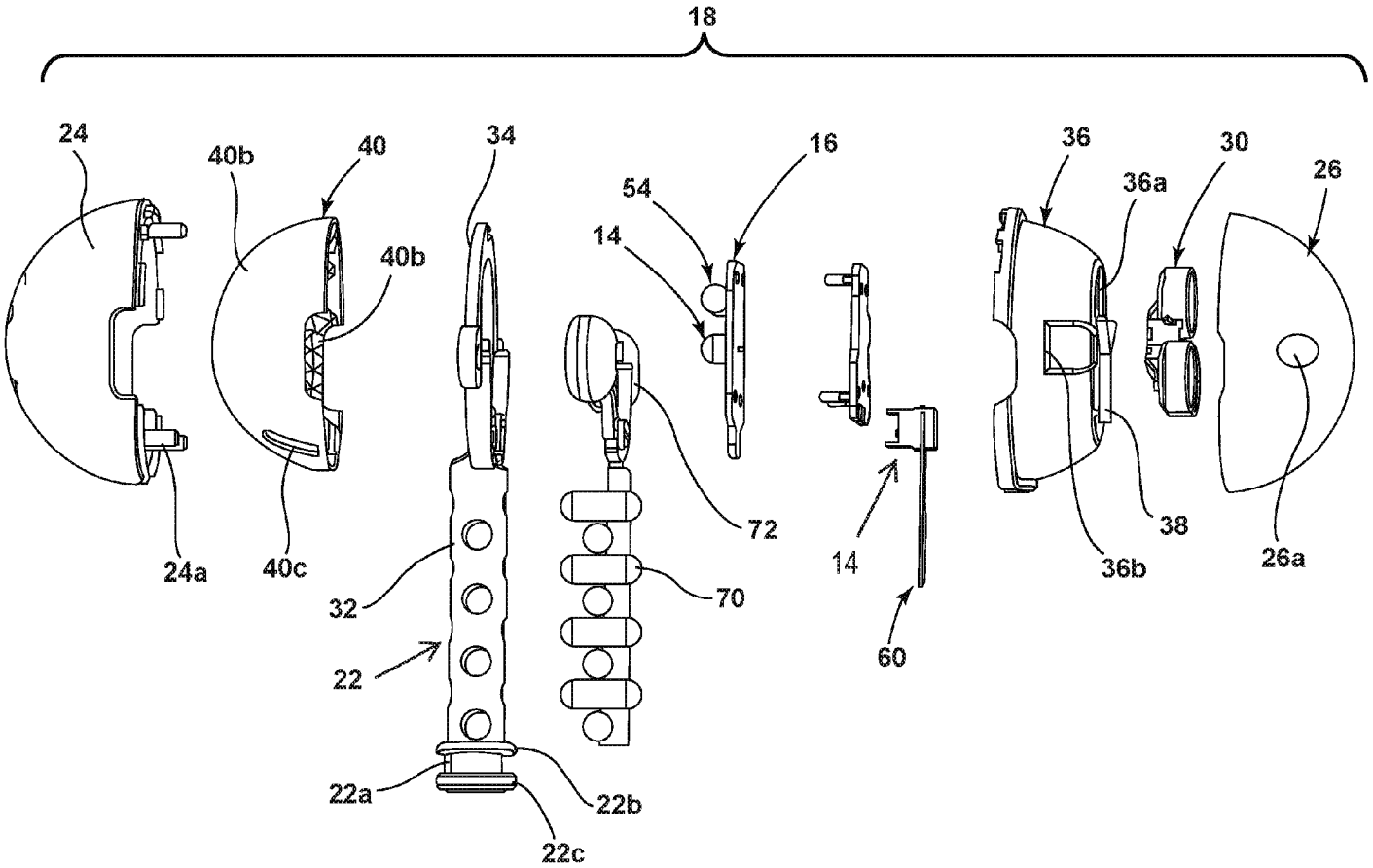
FIG. 3 is an exploded side view of the head and neck of the apparatus of FIG. 1.

Referring to FIGS. 1 and 3, apparatus 10 includes a body 12 with a light source 14 (see FIG. 3) that is mounted in the body, and which is selectively powered by a circuit 16 (see FIG. 5) to emit light in response to motion or movement (these terms are intended to be used interchangeably) of the body. As described above, suitable motion includes intentional motion, such as shaking or tapping or the like. For example, when apparatus 10 is configured a rattle (as described below), short bursts of motion (e.g. relative to the child or infant), such as a shaking motion, will cause the light to turn on, while smoother motion may not trigger a change in the light, though the light might be de-energized as a result of the passage of time as described below. Further, the motion that triggers the change in status of the light may be directional.

Once there is no motion of the type noted above, the light source is de-energized. For example, the light source may be de-energized after a selected period of time of inactivity (lack of motion). The period of time of inactivity may vary from about 180 seconds to 15 seconds, or from about 120 seconds to 45 seconds, and optionally about 60 seconds. If appropriate motion occurs again, then the light source is re-energized.

Additionally, the light source may switch between emitting different intensities or different color lights in response to subsequent or continued motion. This may be random or may be in a sequence. For ease of description, reference hereinafter will be made to switching colors, but it should be understood that the intensity or brightness of the light may be changed as well by illuminating light sources with different intensities or by illuminating multiple light to vary the intensity. For example, the light source may generate a first colored light when the body is first moved, and if the motion continues beyond a first period of time, the color may switch to a second colored light. If the motion continues beyond a second period of time, the color may switch to emitting a third colored light. For a more specific example, if the body is moved, the light will emit a first colored light, if the motion continues beyond about sixty seconds, the light will switch to emitting a second colored light. If the body is moved continuously for an additional sixty seconds, the light will switch to emitting a third colored light. Similarly, if the motion continues for a period of time and but terminates before the color changes, the next motion may cause the light to emit the next colored light.

The colors may vary but optionally include red, blue, and green. As noted the light may switch between the colors in order or randomly. For example, the first light to be generated may be red, the second light that is generated may be blue, and third light may be green. The circuit (described below) may cause the light to first emit red light, for example, and then switch it to blue (based on the conditions noted above), and then to green. After green, the circuit will cycle back to red. Optionally, the rolling may be continuous so that there is no default color—or a default may be provided and, for example, after each time the body has been inactive for period of time, the control circuit defaults to, for example, the red color.

A suitable light source may comprise an LED or multiple LEDs. For example, the color change can be achieved by using multiple LEDs, each with a different color and with each one be independently energized to generate their respective wavelength of the light to produce the desired color. Alternately, this can be achieve with a plurality of LEDs each located behind a colored lens, which each LED being selectively powered to vary the color by way of its associated lens.

Optionally, the control circuit may provide a minimum dwell time for each state. For example, if the body is initially moved, the light (or lights) will be energized to emit a colored light. If the motion stops but is then quickly resumed, the light will still generate the same colored light. If the motion stops, and the motion resumes after the minimum dwell time, then the light (or lights) will be energized to emit another colored light. Therefore, in order for subsequent motions (that is after motion has stopped) to trigger the light to switch colors, the motions must be spaced in time. This will therefore avoid creating a flashing or strobing effect, which may not be suitable in some situations.

In the illustrated embodiment, as noted above, apparatus 10 is configured as a rattle for use with an infant, with body 12 including a head 18 and a base 20. Optionally, head 18 is mounted to base 20 by a handle 22, which may be configured as a neck 22. Optionally each of the head 18, base 20, handle 22 may be formed from a plastic material, such as ABS, and may be joined together by sonic welds, fasteners, or adhesives. It should be understood that the shape and components of the body 12 may be varied depending on its application.

Referring to FIG. 3, head 18 includes a generally spherical shape formed by two semi-spherical covers 24 and 26 that are joined together to form housings to enclose light 14 described above, circuit 16 described below, and a power supply 30 (see FIG. 3) in the form of a battery or batteries. Semi-spherical cover 24 in essence forms the face of the head, but is transparent, while cover 26 forms the back of the head and is non-transparent. Covers 24 and 26 are each mounted to the handle 22, which includes a cylindrical member 32 and an annular flange 34. Annular flange 34 projects upwardly (as viewed in FIG. 1) from cylindrical member 32 to provide a mount for covers 24 and 26. Annular flange 32 includes or supports a truncated semi-spherical shell 36, which nests inside cover 26 and provides a mounting surface for cover 26.

Shell 36 and cover 26 form the battery housing and battery mount. In the illustrated embodiment, the battery mounts comprise three round recesses 36*a* that extend into (e.g. molded into) shell 36, each with a transverse opening to allow electrical connection of the battery or batteries to electrical leads of circuit 16. The recesses are separated by an upwardly extending Y shaped web 38 which inserts into a Y-shaped channel (not shown) formed (e.g. by molding) on the inwardly facing side of cover 26 to assist with the alignment of cover 26 over shell 36. Cover 26 is secured over shell 36 by fasteners that are recessed in openings 26*a* and extend into recessed openings 36*b* formed in shell 36. In addition, cover 26 may also include projecting structures, such as hollow cylindrical bodies, that align with and contact the back of the battery or batteries to hold the battery or batteries in place in their respective recesses.

Cover 24 is mounted to the opposed side of annular flange 34 over a second semi-spherical shell 40, which is joined with annular flange 40 by an adhesive or welding to form (with the inside of shell 36) the housing for the light source 14 and circuit 16. Shell 24 may be configured as a translucent or transparent lens through which the light from light source 14 is passed and optionally diffused. For example, shell 40 may include optical structures 40*a* in its inside surface to diffuse the light so that when the light is powered, the whole surface of the shell is uniformly illuminated and also visible through transparent cover 24. Optionally, the shell 40 includes facial feature 42, 44, 46 that are painted or formed on its surface 40*b*, such as at its outer surface. In this manner, the outer surfaces of the rattle may be free of paint. Alternately, shell 40 may be omitted with cover 24 formed with the facial features, such as by molding, and with the cover also being formed as the lens.

Figure 5:
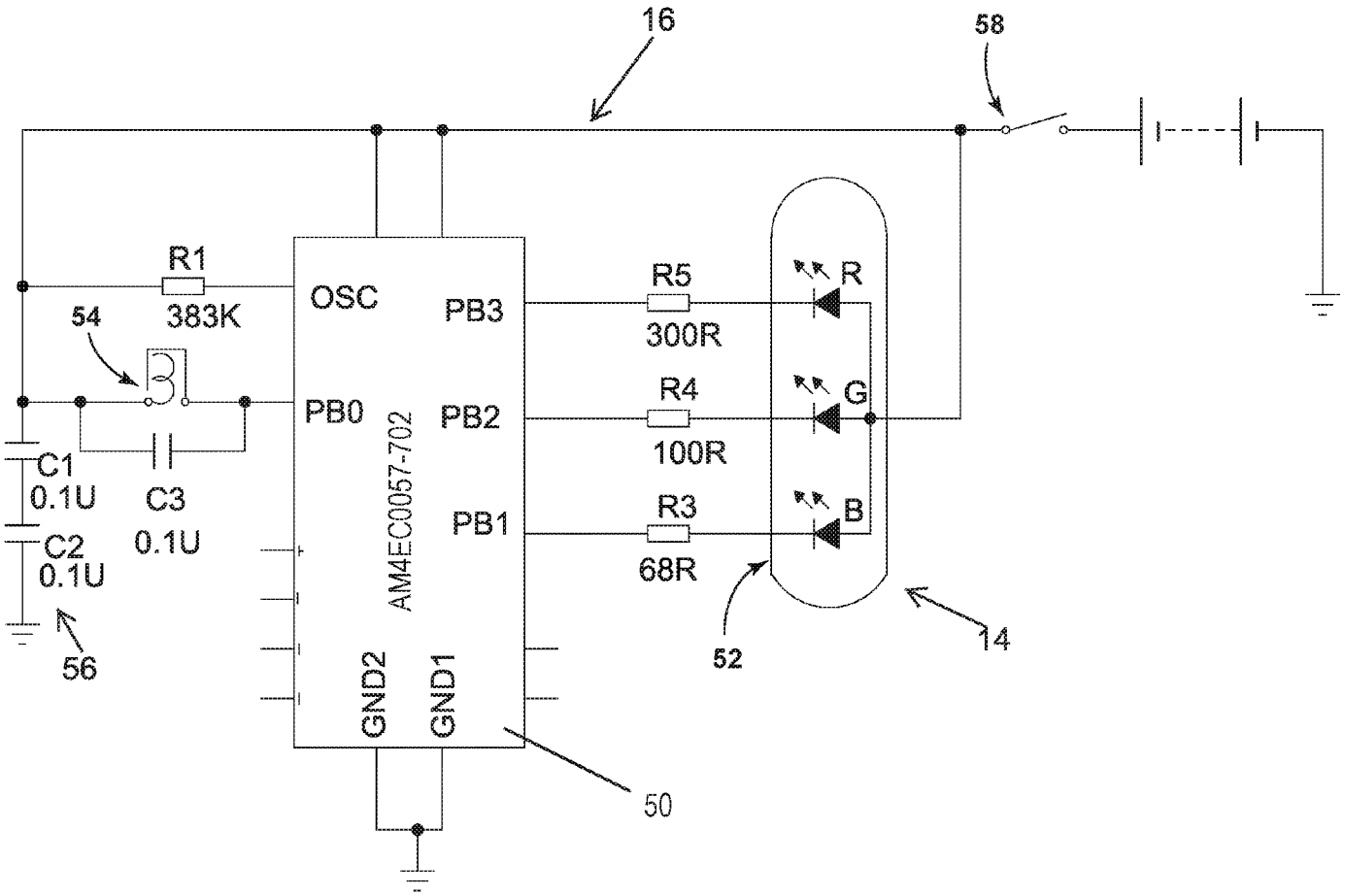
FIG. 5 is a schematic drawing of the control circuit for the apparatus the present invention.

To mount cover 24 to shell 40, cover 24 optionally includes projecting hollow posts 24*a* that extend into corresponding slotted openings 40*c* formed in shell 40 and are then joined with flange 34, such as by welding, along with shell 40. As noted above, cover 24 and shell 40 (and shell 36) form a housing for light 14 and circuit 16. Referring now to FIG. 5, circuit 16 forms a driver for the LED (LEDs) and optionally a central processing unit (CPU) 50, which selectively powers light source 14 as noted above. The voltage inputs of CPU 50 are connected to batteries 30 via leads, which connect to the batteries through the back of shell 36. Optionally, the leads include a switch, including an on/off switch, to allow the batteries to be connected (as described below) or disconnected.

In the illustrated embodiment, light source 14 comprises an RGB LED 52, which includes three LEDs in one unit, which facilitates assembly, with a single, common ground lead, and three power leads, one for each LED, which connect to power outputs of CPU 50. CPU 50 may be configured to switch its drive signals between its power output connections in a rolling sequence as noted above. For example, CPU 50 may initially energize the red LED, followed by energizing the blue LED, which will be followed by energizing the green LED. Circuit 16 also includes a motion detector 54, which provides input to CPU 50 and which triggers the powering of one of the LEDs. In the illustrated embodiment, motion detector 54 comprises a spring motion switch. In addition, circuit 16 may include filter capacitors 56, which filter out noise from motion detector 54. Once CPU 50 receives a signal from detector 54, the CPU latches the signal, which triggers the CPU to power one of the LEDs. The CPU sends a power signal to the LED for a selected or predetermined time so that the light will remain energized even during a period of time of inactivity (lack of triggering motion). Therefore, CPU 50 either includes a clock or timing circuit or is coupled to timing circuit. For example, as noted, the period of time of inactivity may vary from about 180 seconds to 15 seconds, or from about 120 seconds to 45 seconds, and optionally about 60 seconds. If appropriate motion occurs again before the time is up or even after the time is up, CPU 50 will generate a power signal for the second LED. Similarly, if no further signal is received from motion detector 54, CPU 50 will de-energize the second LED after the period of time measured from the last effective (see below) input from the motion detector 54. If appropriate motion occurs again before the time is up or even after the time is up, CPU 50 will generate a power signal for the third LED. Similarly, if no further signal is received from motion detector 54, CPU 50 will de-energize the third LED. Otherwise, the cycle will begin again.

As noted above, there may be times when the signal from motion detector 54 is ineffective. In other words, if motion occurs too quickly, the CPU is configured to ignore the signal and not switch to the next LED. This is to prevent the creation of a flashing light or probe effect, when a flashing or probing light is not desired. So for example, CPU 50 may be configured to have a minimum trigger time—or a minimum dwell time. In this manner, CPU 50 requires a minimum time between receiving signals from motion detector 54 before acting on the signal from the motion detector. For example, re-triggering may be prevented for a dwell time of less than about 0.5 sec or less than about 1 second.

As noted above, circuit 16 may include a switch to close or open the electrical connection to the batteries. For example, to allow the batteries to be sold with the rattle, the rattle may include a pull tab 60, which when pulled allows the lead to make contact with the batteries, in essence forming a one-way permanent switch. Alternately, an on-off switch may be provided, for example, at the back of the head or in the neck or base.

Figure 4:
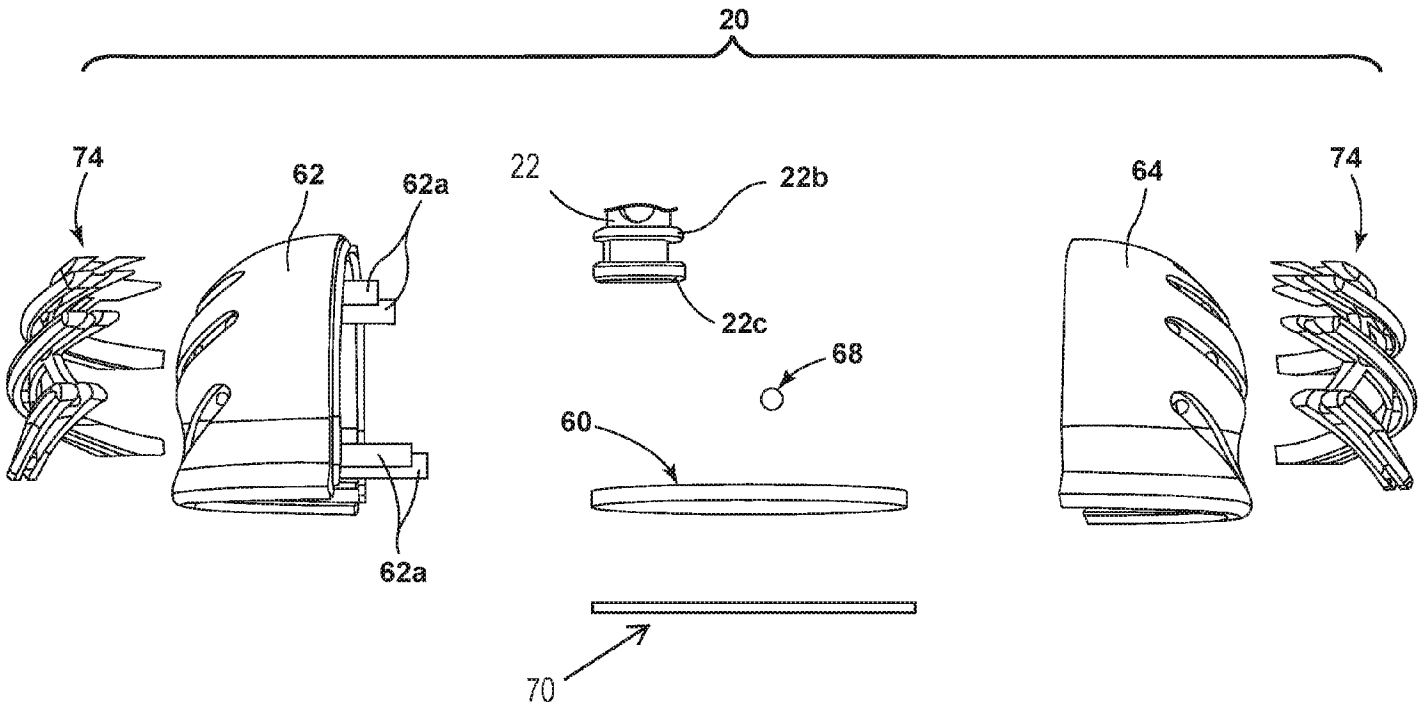
FIG. 4 is an exploded side view of the base of the apparatus of FIG. 1.

As noted above, apparatus 10 may also be configured to generate noise. Referring to FIG. 4, base 20 may be formed by two partial semi-spherical covers 62 and 64 with flared lower rims, which when joined together form a bell-shaped base with a flat bottom surface so that the rattle can sit on a horizontal surface and support the rattle in an upright orientation.

When joined, covers 62 and 64 form an upper opening to receive the lower end of cylindrical handle 22. Lower end of handle 22 includes a narrowed neck 22*a* between two shoulders 22*b* and 22*c*, which capture handle 22 in base when covers 62 and 64 are joined together about the narrowed neck of handle 22. Further, as noted above, the joint may be formed by sonic welding. Cover 62 also may include hollow mounting posts, which extend unto corresponding receivers (not shown) in cover 64 and are joined therewith also by sonic welding. Optionally, the various components may also be joined by an adhesive.

Also captured between covers 62 and 64 in their lower rims is a plate 66, which forms the flat bottom of apparatus and also forms a closed chamber in base 20 for holding a plurality of bodies 68, such as plastic beads, to make a rattle noise associated with most infant rattles when apparatus 10 is shaken. In addition, optionally positioned beneath plate 66 is a reflective disc 70, formed from PETG. In this manner, when a child is playing with the rattle the child can see their reflection in the base of the toy.

Optionally, apparatus 10 may also incorporate one or more tactile surfaces or structures, including on the handle, base and/or head. For example, the tactile surface or structures may be formed for a softer, rubber material, such as thermoplastic rubber (TPR). As best seen in FIG. 3, tactile structures in the form of bumps or semi-spherical bodies 70 may be formed on handle 22 by overmolding. Handle 22 may comprise a hollow cylinder, as noted, with transverse through-holes so that the material forming the bumps can also be injected into the hollow core of the handle to thereby mechanically coupling the tactile structures to the handle. Similarly, ears 72 can be formed on the head and may be formed during the same molding process and from the same material forming the bumps.

As best seen in FIG. 4, raised stripes 74 may be molded onto base 20 and into, for example, recesses formed on the outer surface of covers 62 and 64. Optionally, the recesses may include transverse openings so that the material forming the strips may flow to the inside of base and form a mechanical coupling between the tactile structures and the base.

To use the toy, for example with a newborn, a parent or caregiver can hold the toy in front of a child for example in a range of about 8 to 12 inches from the face of the child. When the child is looking at the toy, it is often helpful to talk to the child and tell them what wonderful job they are doing. Then the parent can then tap or shake the toy to change the colors to see which color the child enjoys the most. Also what may be helpful is to tell a child what color they are looking at. While still a newborn, it may be best to have the child in a reclined position and to hold the toy horizontally front of the child. In addition to turning the light on and changing the colors of the light, the parent can shake the toy gently at a distance from about 8-12 inches from one of the baby's ears and then to the move it to the other ear at the same distance and then shake it again. The toy also may be used when the child is on its stomach. This can help the child strengthen its neck and upper body muscles, which may help prevent motor delays.

Once the child can watch the toy move, then the parent can move the toy from side to side in a horizontal movement, still in front of the child. This can occur as early as one month, which is referred to as visual tracking. It is important to encourage the child to try to watch and follow the lighted end of the toy as you move it slowly as it is move slowly from side to side. At this stage, the toy may be positioned in a range of 10 to 12 inches from the face of the child. Once the child has reached to three to four months of age, parent can then move the toy in a vertical up and down motion as well. In addition to tracking, a parent may use the toy to encourage baby to grasp a part of the toy. Giving a child interesting toys to grasp, helps them to develop the small muscles in their hands, which are used later on in life to scribble draw and write.

At about four months of age or more, a child can be encouraged to shake the toy, transfer the toy from one hand to another, and reach for it, all of which help in developing eye and hand coordination.

Accordingly, as would be understood, apparatus 10 can be used to enhance the visual and/or auditory development of an individual, particularly infants and young children.

Various alterations and changes can be made to the above-described embodiments without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

I claim:

1. An infant development toy comprising:

a body configured as an infant toy body to be held by a person;

a light source located on or within said body, said light source being configured to be energized by motion of the body and deactivated automatically after a period of time of inactivity but then re-energized when motion reoccurs; and a circuit configured to selectively power said light source, wherein said circuit is configured to power said light source to generate a first color in response to a first motion and to power said light source to generate a second color in response to a subsequent motion only when said subsequent motion occurs after a minimum time delay after said first motion whereby said circuit delays switching between said first and second colors to thereby prevent said toy from creating a flashing light or probe effect.

2. The development toy according to claim 1, wherein said light source is configured to be energized by motion consisting of shaking of the body or tapping of the body on a surface.

3. The development toy according to claim 1, wherein said toy comprises a rattle.

4. The development toy according to claim 1, wherein said body includes a base and a head, with the light source located in the head.

5. The development toy according to claim 4, further comprising one or more tactile surfaces or structures.

6. The infant development toy according to claim 1, wherein said body includes one or more tactile surfaces or structures, and wherein said one or more tactile surfaces or structures comprise semi-spherical bodies.

7. The development toy according to claim 4, further comprising a handle, said handle connecting said head to said base and forming a neck.

8. The development toy according to claim 1, further comprising housing a plurality of beads in the body to form a rattle.

9. The infant development toy according to claim 1, wherein said light source comprises a plurality of light sources, each of said light sources generating a colored light when powered by said circuit.

10. The development toy according to claim 1, wherein said light source comprises a RGB LED unit.

11. The development toy of claim 10, wherein said circuit includes a central processor unit, a motion detector, and a timer wherein said central processor unit powers said light source to generate a first color in response to said motion detector detecting said first motion and powers said light source to generate said second color when said motion detector detects said subsequent motion only when said subsequent motion occurs after the minimum time delay after said first motion as measured by said timer.

12. An infant development toy comprising:

a body configured as an infant toy body to be held by a person;

a light source located on or within said body, said light source being configured to be energized by motion of the body and deactivated automatically after a period of time of inactivity but then re-energized when motion reoccurs; and a circuit, the circuit powering the light source to generate a first colored light in response to a first motion and powering the light source to generate a second colored light in response to a second motion only when said second motion occurs after a time delay after said first motion, and said circuit powering said light source to generate a third colored light in response to a third motion only when said third motion occurs after a time delay after said second motion whereby said circuit delays switching between said colors to prevent said toy from creating a flashing light or probe effect.

13. The development toy of claim 12, wherein said first colored light, said second colored light, and said third colored light comprise colored light selected from the group consisting of red light, blue light, and green light.

* * * * *